US005964203A

United States Patent [19]

Sato et al.

[11] Patent Number: 5,964,203

[45] Date of Patent: Oct. 12, 1999

[54] THROTTLE VALVE DEVICE OF INTERNAL COMBUSTION ENGINE

[75] Inventors: Hisaaki Sato; Ikuo Mogi, both of Gunma; Masato Kumagai, Saitama; Munehiro Kudo; Keiichi Kai, both of Gunma, all of Japan

[73] Assignee: Unisia Jecs Corporation, Atsugi, Japan

[21] Appl. No.: 09/002,393

[22] Filed: Jan. 2, 1998

[30] Foreign Application Priority Data

Jan. 9, 1997 [JP] Japan ..... 9-002082

[51] Int. Cl.[6] ..... F02M 7/12

[52] U.S. Cl. ..... 123/396; 123/400

[58] Field of Search ..... 123/336, 400, 123/396, 179.18, 98, 361; 74/526, 516; 261/52, 64.4

[56] References Cited

U.S. PATENT DOCUMENTS

| | | | |
|---|---|---|---|
| 3,699,943 | 10/1972 | Eshelman | 123/98 DB |
| 4,094,281 | 6/1978 | Kittler | 123/98 |
| 4,287,789 | 9/1981 | Dudleston et al. | 74/516 |
| 4,796,579 | 1/1989 | Wolfe et al. | 123/336 |
| 4,856,477 | 8/1989 | Hanaoka et al. | 123/399 |
| 4,928,647 | 5/1990 | Villanyi et al. | 123/400 |
| 4,947,815 | 8/1990 | Peter | 123/399 |

FOREIGN PATENT DOCUMENTS

| | | |
|---|---|---|
| 2-500677 | 3/1990 | Japan . |
| 1 587 876 | 4/1981 | United Kingdom . |
| 2 233 039 | 1/1991 | United Kingdom . |

*Primary Examiner*—Willis R. Wolfe, Jr.
*Assistant Examiner*—Mahmoud M. Gimie
*Attorney, Agent, or Firm*—Foley & Lardner

[57] ABSTRACT

A throttle valve device for use in an internal combustion engine comprises a valve shaft extending across an air induction passage of the engine. A valve plate is fixed to the valve shaft to rotate therewith in the air induction passage. An electric actuator is connected to one end of the valve shaft to rotate the valve shaft with the aid of electric power. A biasing cam structure is incorporated with the valve shaft to bias the valve place toward a predetermined intermediate open position. The biasing cam structure comprises a cam plate which is secured to the other end of the valve shaft to rotate therewith and has a generally V-shaped cam edge; a loading lever which has a base end pivotally connected to a fixed portion; a follower member which is connected to a leading end of the loading lever and slidably engaged with the V-shaped cam edge; and a biasing member which biases the loading lever in a direction to press the follower member against the V-shaped cam edge.

8 Claims, 3 Drawing Sheets

THROTTLE VALVE DEVICE OF INTERNAL COMBUSTION ENGINE

The contents of Japanese Patent Application 9-2082 filed Jan. 9, 1997 are hereby incorporated by reference.

BACKGROUND OF THE INVENTION

1. Field of the Invention

The present invention relates in general to throttle valve devices of an internal combustion engine, and more particularly to throttle valve devices of a type which is equipped with a biasing mechanism for biasing and holding a throttle valve toward and at a predetermined intermediate open position.

2. Description of the Prior Art

In automotive internal combustion engines having a throttle valve actuated by an electric motor, there has been known a biasing mechanism by which, upon failure of the motor, the throttle valve is automatically shifted to a predetermined intermediate open position. One of such biasing mechanisms is shown in Japanese Patent First Provisional Publication 2-500677.

In general, such a biasing mechanism uses both a return spring for biasing the throttle valve in a closing direction and a counter spring for biasing the valve in an opposite, viz., opening direction.

However, due to its inherent construction, the biasing mechanism is poor in freely adjusting a biasing force applied to the throttle valve. Moreover, usage of the two springs tends to increase the cost of the mechanism and thus that of entire of the throttle valve device. Furthermore, usage of the two springs tends to make the mechanism bulky in size and cause the assembly of the mechanism to be troublesome.

SUMMARY OF THE INVENTION

It is therefore an object of the present invention to provide a throttle valve device having a biasing mechanism which is free of the above-mentioned drawbacks.

According to a first aspect of the present invention, there is provided a throttle valve device for use in an internal combustion engine having an air induction passage. The throttle valve device comprises a valve shaft extending across the air induction passage; a valve plate fixed to the valve shaft to rotate therewith in the air induction passage; an electric actuator connected to one end of the valve shaft to rotate the valve shaft with the aid of electric power; and a biasing cam structure incorporated with the valve shaft to bias the valve place toward a predetermined intermediate open position, wherein the biasing cam structure comprises a cam plate secured to the other end of the valve shaft to rotate therewith, the cam plate having a generally V-shaped cam edge; a loading lever having a base end pivotally connected to a fixed portion; a follower member connected to a leading end of the loading lever and slidably engaged with the V-shaped cam edge; and a biasing member for biasing the loading lever in a direction to press the follower member against the V-shaped cam edge.

According to a second aspect of the present invention, there is provided a throttle valve device for use in an internal combustion engine having an air induction passage. The throttle valve device comprises a valve shaft extending across the air induction passage; a valve plate fixed to the valve shaft to rotate therewith in the air induction passage; an electric actuator connected to one end of the valve shaft to rotate the valve shaft with the aid of a electric power; and a biasing cam structure incorporated with the valve shaft to bias the valve place toward a predetermined intermediate open position, the biasing cam structure including a cam plate which is secured to the other end of the valve shaft to rotate therewith and has a generally V-shaped cam edge; a loading lever which has a base end pivotally connected to a fixed portion; a roller which is rotatably connected to a leading end of the loading lever and runs on and along the V-shaped cam edge; and a biasing member which biases the loading lever in a direction to press the roller against the V-shaped cam edge, wherein the V-shaped cam edge includes comprises first and second inclined parts which are joined at their lower ends to form a curved bottom part of the V-shaped cam edge; and wherein a radius of the roller is greater than a radius of curvature of the curved bottom part.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
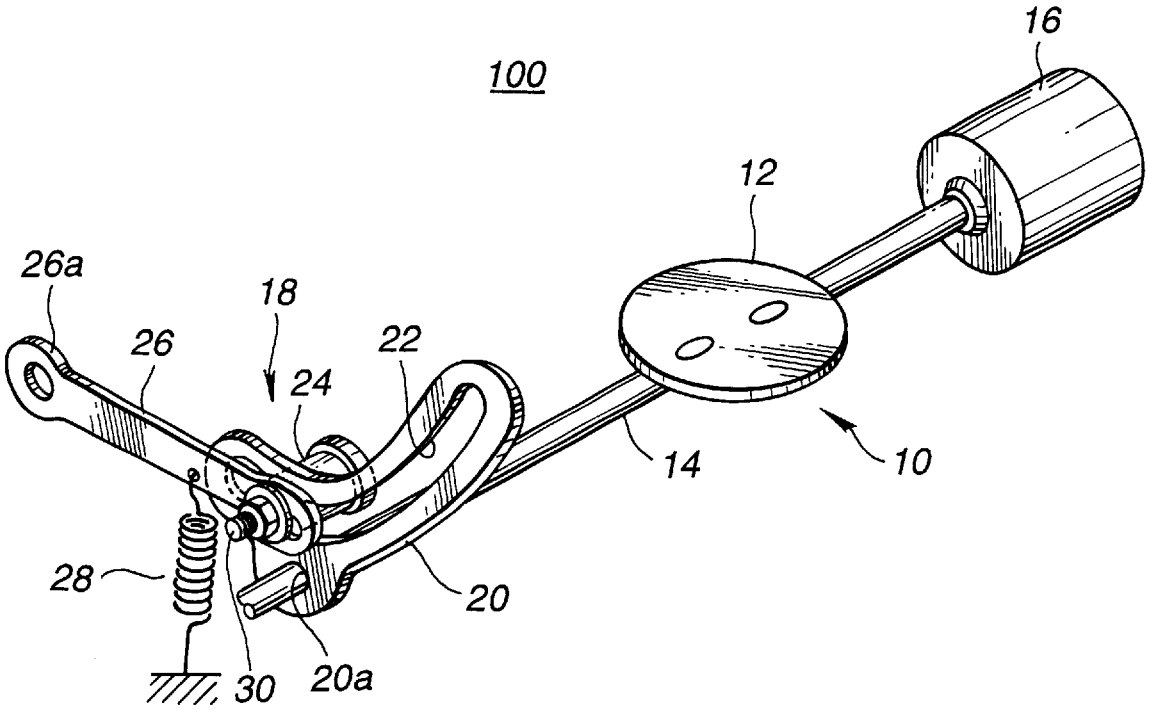
FIG. 1 is a perspective view of a throttle valve device according to the present invention.

Referring to FIG. 1, there is shown a throttle valve device 100 according to the present invention.

The device 100 comprises a throttle valve 10 of butterfly type which is installed in an air induction passage 11 (see FIG. 3) of an internal combustion engine. The throttle valve 10 includes a circular valve plate 12 fixed to a valve shaft 14.

The valve shaft 14 is connected at one end to an electric motor 16 through a gear mechanism (not shown). Although not shown in the drawing, the motor 16 and the gear mechanism are positioned outside of the air induction passage. Upon energization of the motor 16, the valve plate 12 is turned in a closing or opening direction to close or open the air induction passage. More specifically, by stopping the motor 16, the valve plate 12 can assume a desired angular position in the air induction passage.

The valve shaft 14 is equipped at the other end with a biasing cam structure 18. Also this biasing cam structure 18 is positioned outside of the air induction passage.

The biasing cam structure 18 comprises a plate cam 20 which is secured to the valve shaft 14 to pivot therewith about an axis of the valve shaft 14. The plate cam 20 is formed with a generally V-shaped guide slot 22. A follower or roller 24 runs in and along the guide slot 22, which is connected to a leading end of a pivotal loading lever 26. The loading lever 26 pivots at its base end 26*a* about an axis parallel with the axis of the valve shaft 14. The loading lever 26 is biased by a spring 28 in a given direction, that is, in a direction to rotate the valve plate 12 to a predetermined intermediate open position, as will become apparent as the description proceeds.

Figure 2:
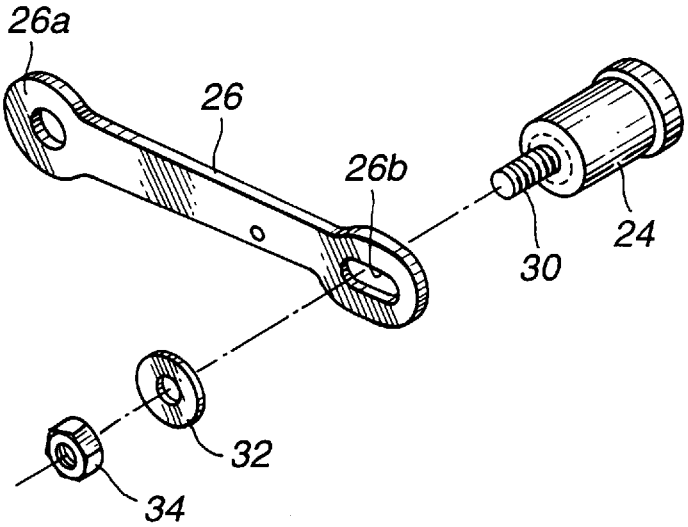
FIG. 2 is an exploded view of a loading lever and a roller which are employed in the throttle valve device of the present invention.

The manner in which the roller 24 is held by the leading end of the loading lever 26 is shown in FIG. 2. That is, the leading end of the loading lever 26 is formed with an elongate opening 26*b*. The roller 24 is rotatably disposed through a bearing (no numeral) on a bolt 30 which passes through the elongate opening 26*b*. By using a washer 32 and a nut 34, the bolt 30 is fixed to the leading end of the loading lever 26. Due to nature of the elongate opening 26*b*, the position of the roller 24 relative to the loading lever 26 is adjustable.

Figure 3:
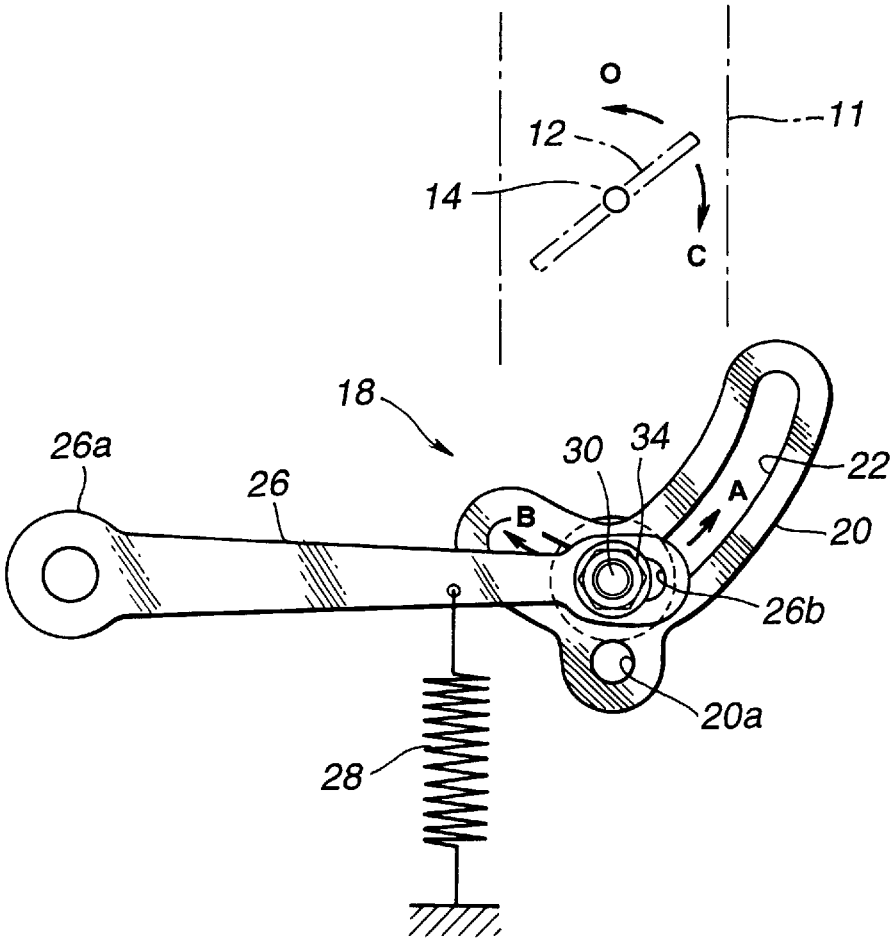
FIG. 3 is a front view of a biasing cam structure employed in the throttle valve device of the invention.
Figure 4:
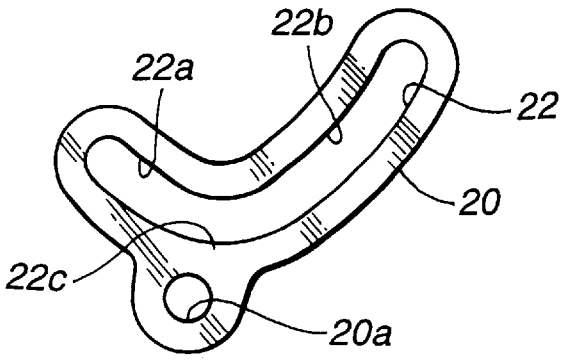
FIG. 4 is a front view of a plate cam which is a part of the biasing cam structure.

The biasing cam structure 18 and the plate cam 20 used therein are shown in FIGS. 3 and 4 respectively. As is seen from FIG. 4, the plate cam 20 has, at a lower portion thereof, an opening 20*a* with which the valve shaft 14 is tightly engaged.

The guide slot 22 of the plate cam 20 comprises a shorter curved part 22*a* and a longer curved part 22*b* which are joined at their lower ends near the opening 20*a*. Thus, the V-shaped guide slot 22 has a curved bottom part 22*c* near the opening 20*a*. If desired, each part 22*a* or 22*b* of the guide slot 22 may have a straight shape.

It is to be noted that in the cam plate 20 shown in FIG. 4, the opening 20*a* is located just below the bottom part 22*c* of the guide slot 22. Preferably, the opening 20*a* is in non-circular shape to assure the secured connection between plate cam 20 and the valve shaft 14.

As is seen from FIG. 3, the spring 28 functions to bias the loading lever 26 downward, that is, in a direction to press the roller 24 against a lower cam edge of the guide slot 22.

It is now to be noted that when, as will be seen from FIG. 3, the valve plate 12 is in the predetermined intermediate open position (which will be referred to as "PIOP" for ease of description), the roller 24 is placed on the bottom part 22*c* of the guide slot 22 while being pressed against the same. That is, when, in FIG. 3, the valve plate 12 pivots in a counterclockwise opening direction "O" from the illustrated "PIOP" position, the open degree of the air induction passage increases, while, when the valve plate 12 pivots in a clockwise closing direction "C" from the illustrated "PIOP" position, the open degree of the air induction passage decreases.

Preferably, a radius of the roller 24 is greater than a radius of curvature of the bottom part 22*c* of the guide slot 22. With this, the roller 24 can contact the bottom part 22*c* at two points while achieving a stable positioning thereon.

In the following, operation will be described with reference to FIGS. 1 and 3. For ease of understanding, the description will be commenced with respect to a condition where the valve plate 12 is in the illustrated "PIOP" position. Under this condition, the roller 24 on the loading lever 26 is on the bottom part 22*c* of the V-shaped guide slot 22.

When, upon energization of the motor 16, the valve plate 12 is rotated in the opening direction "O", the plate cam 20 is rotated in a counterclockwise direction causing the roller 24 to run in the longer curved part 22*b* of the guide slot 22 in the direction of arrow "A" (see FIG. 3).

While, when, upon energization of the motor 16, the valve plate 12 is rotated in the closing direction "C" from the "PIOP" position, the plate cam 20 is rotated in a clockwise direction causing the roller 24 to run in the shorter curved part 22*a* of the guide slot 22 in the direction of arrow "B".

It is now to be noted, that due to function of the spring 28, movement of the roller 24 into the longer or shorter curved part 22*b* or 22*a* increases a force by which the plate cam 20 is biased toward the "PIOP" position.

It is further to be noted that, due to the above-mentioned biasing cam structure 18, the control of the valve plate 12 by the motor 16 is carried out against the biasing force produced by the biasing cam structure 18.

Accordingly, when, due to failure of the engine and/or the motor 16, the motor 16 fails to produce a torque for actuating the valve plate 12, the valve plate 12 is automatically moved to the "PIOP" position due to the force of the spring 28. With this, the vehicle can move but slowly. Furthermore, undesired seizing of the valve plate 12 due to freezing of the same is prevented.

In the following, advantages of the throttle valve device of the present invention will be described.

First, as is mentioned hereinabove, when the motor 16 fails to operate, the valve plate 12 is automatically moved to the "PIOP" position. Thus, the vehicle can move but slowly, and undesired seizing of the valve plate 12 due to freezing is prevented.

Second, because of simple construction of the biasing cam structure 18 which uses only one spring 28, it is easy to adjust the biasing force applied to the throttle valve, that is, the valve plate 12. Due to the same reason, the throttle valve device can be made compact in size and economical. Of course, due to the simple construction, the throttle valve device can be easily mounted to an air induction system of the engine.

Third, by changing the spring 28 and/or the cam plate 20, the biasing force produced by the biasing cam structure 18 is readily changed.

Fourth, leading ends of the longer and shorter curved parts 22*b* and 22*a* of the V-shaped guide slot 22 can serve as stoppers for the roller 24 to limit the rotational movement of the valve plate 12.

In the following, modifications of the biasing cam structure 18 will be described with reference to FIGS. 5 and 6.

Figure 5:
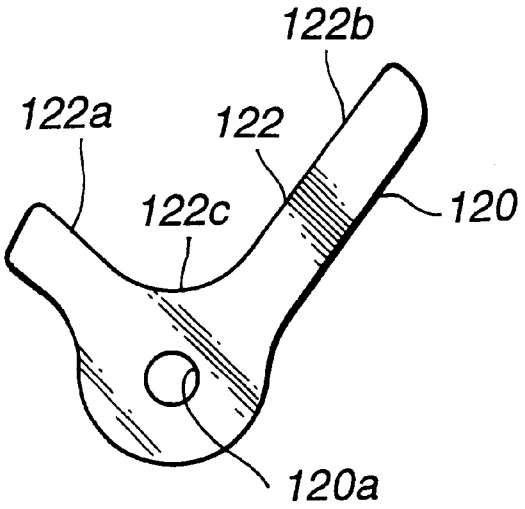
FIG. 5 is a front view of another plate cam employable in the biasing cam structure.

FIG. 5 shows a cam plate 120 used in a first modification. As shown, the cam plate 120 is formed with a generally V-shaped recess 122 which includes a shorter edge part 122*a* and a longer edge part 122*b* which are joined at their lower ends to form a curved bottom part 122*c*. As shown, below the bottom part 122*c*, there is formed an opening 120*a* with which the valve shaft 14 is tightly engaged. The roller 24 (see FIG. 2) runs on and along the edge of the V-shaped recess 122 in substantially the same manner as has been described hereinafore.

Figure 6:
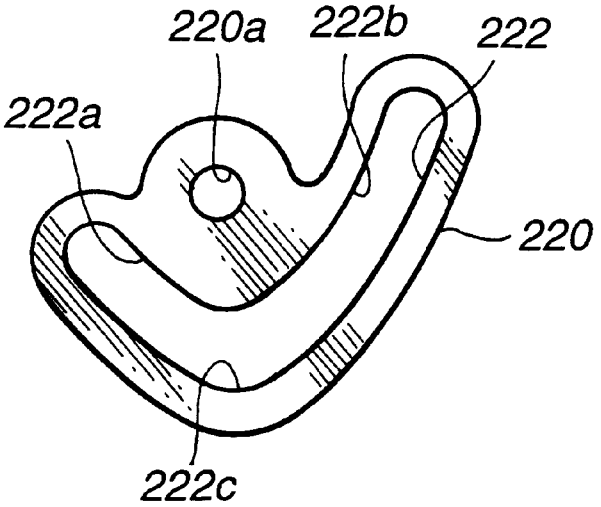
FIG. 6 is a front view of still another plate cam employable in the biasing cam structure.

FIG. 6 shows a cam plate 220 used in a second modification. As shown, the cam plate 220 is formed with a generally V-shaped guide slot 222. The guide slot 222 comprises a shorter curved part 222*a* and a longer curved part 222*b* which are joined at their lower ends to form a curved bottom part 222*c*. As shown, above the bottom part 222*c*, there is formed an opening 220*a* with which the valve shaft 14 is tightly engaged. The roller 24 (see FIG. 2) runs on and along a lower edge of the V-shaped recess 222 in substantially the same manner as has been described hereinafore.

In these modifications, substantially same advantages as those described hereinabove are obtained.

What is claimed is:

1. A throttle valve device for use in an internal combustion engine having an air induction passage, comprising:

a valve shaft extending across said air induction passage;

a valve plate fixed to said valve shaft to rotate therewith in said air induction passage;

an electric actuator connected to one end of said valve shaft to rotate said valve shaft with the aid of electric power; and a biasing cam structure incorporated with said valve shaft to bias said valve plate toward a predetermined intermediate open position, wherein said biasing cam structure comprises:

a cam plate secured to the other end of said valve shaft to rotate therewith, said cam plate having a generally V-shaped cam edge;

a loading lever having a base end pivotally connected to a fixed portion;

a follower member connected to a leading end of said loading lever and slidably engaged with said V-shaped cam edge; and a biasing member for biasing said loading lever in a direction to press said follower member against said V-shaped cam edge.

2. A throttle valve device as claimed in claim 1, in which said V-shaped cam edge comprises a first part and a second part which are joined at their lower ends to form a curved bottom part of said V-shaped cam edge, and in which said curved bottom part receives thereon said follower member when said valve plate assumes said predetermined intermediate open position.

3. A throttle valve device as claimed in claim 2, in which said V-shaped cam edge is defined by a generally V-shaped guide slot formed in said cam plate, said guide slot having said follower member slidably received therein.

4. A throttle valve device as claimed in claim 2, in which said follower member is a roller which is rotatably carried by said loading lever and runs on and along said V-shaped cam edge.

5. A throttle valve device as claimed in claim 2, in which said curved bottom part of said V-shaped cam edge is positioned just above a portion of said cam plate to which said valve shaft is secured.

6. A throttle valve device as claimed in claim 2, in which said curved bottom part of said V-shape cam edge is positioned just below a portion of said cam plate to which said valve shaft is secured.

7. A throttle valve device as claimed in claim 4, in which a radius of said roller is greater than a radius of curvature of said curved bottom part of said V-shaped cam edge.

8. A throttle valve device for use in an internal combustion engine having an air induction passage, comprising:

a valve shaft extending across said air induction passage;

a valve plate fixed to said valve shaft to rotate therewith in said air induction passage;

an electric actuator connected to one end of said valve shaft to rotate said valve shaft with the aid of electric power; and a biasing cam structure incorporated with said valve shaft to bias said valve plate toward a predetermined intermediate open position, said biasing cam structure including a cam plate which is secured to the other end of said valve shaft to rotate therewith and has a generally V-shaped cam edge; a loading lever which has a base end pivotally connected to a fixed portion; a roller which is rotatably connected to a leading end of said loading lever and runs on and along said V-shaped cam edge; and a biasing member which biases said loading lever in a direction to press said roller against said V-shaped cam edge, wherein said V-shaped cam edge includes comprises first and second inclined parts which are joined at their lower ends to form a curved bottom part of said V-shaped cam edge; and wherein a radius of said roller is greater than a radius of curvature of said curved bottom part.

* * * * *